United States Patent [19]

Koets

[11] Patent Number: 4,639,709

[45] Date of Patent: Jan. 27, 1987

[54] THERMOSTAT WITH ADJUSTABLE TEMPERATURE RANGE SETPOINT STOPS

[75] Inventor: Howard Koets, Edina, Minn.

[73] Assignee: Honeywell Inc., Minneapolis, Minn.

[21] Appl. No.: 871,339

[22] Filed: Jun. 6, 1986

[51] Int. Cl.[4] ..... H01H 37/12

[52] U.S. Cl. ..... 337/360; 337/323; 116/324; 74/526

[58] Field of Search ..... 337/360, 323; 74/526; 116/324, 331

[56] References Cited

U.S. PATENT DOCUMENTS

| | | | |
|---|---|---|---|
| 623,392 | 4/1899 | Adams | 246/122 |
| 2,593,868 | 4/1952 | Fowler | 65/61 |
| 2,704,048 | 3/1955 | Perier | 116/135 |
| 2,883,868 | 4/1959 | Fresard et al. | 74/96 |
| 3,204,639 | 9/1965 | Kleffman | 129/16.8 |
| 3,452,616 | 7/1969 | Nelson et al. | 74/526 |
| 3,807,254 | 4/1974 | Brakebill | 74/526 |
| 3,999,158 | 12/1976 | Rae | 337/360 |
| 4,090,165 | 5/1978 | Rae | 337/360 |

*Primary Examiner*—Harold Broome
*Attorney, Agent, or Firm*—Alfred N. Feldman

[57] ABSTRACT

A thermostat has a lever that adjusts the set point of the thermostat. The lever is limited in its movement by a pair of stops. The stops are inserted in a geometrically designed slot and can be readily moved for convenient adjustment.

5 Claims, 5 Drawing Figures

THERMOSTAT WITH ADJUSTABLE TEMPERATURE RANGE SETPOINT STOPS

BACKGROUND OF THE INVENTION

Thermostats that are used in offices, restaurants, hotels, and similar types of location are subject to extensive setpoint temperature changes by unauthorized individuals. In some types of installations, it is necessary to place a locked cover over a thermostat to maintain a proper temperature setting. In other locations it is desirable to allow the persons having access to the thermostat to make limited temperature changes. This is particularly true in hotels and motels.

It has been common in this type of thermostat to provide adjustable stops. Two stops are placed in the thermostat and allow a temperature control lever to be moved between two pre-established limits. This typically has been done by the use of a screwdriver adjustment wherein the stop is mechanically locked down in its desired position. This tends to lead to a situation in which convenient changes of the stops cannot be made without tools. Also, this structure can be accidentally damaged if the screws are over tightened. Further, the amount of change of the setting of the stops is a matter of judgement, or must be calibrated with a separate temperature scale.

SUMMARY OF THE INVENTION

The present invention is directed to an easily adjusted stop means for a thermostat. The stop means is provided in the form of a peg-like member that has three projections. The projections are placed on opposite sides of a plane that passes through the stop means. One projection is centered while the two projections on the opposite side of the plane are offset from the center.

The projections are made to conform to a geometric design of a slot that is molded into the base of the thermostat. The geometric design includes a plurality of offset and recessed openings on opposite sides of the slot. The openings are selected so that the spacing between them will allow for the stop means to be placed and held by frictional engagement. The geometric design further has its offset recessed openings placed so that stop means placed in the slot provide approximately one degree Fahrenheit in allowable travel of a lever means that is used for adjustment of the thermostat.

With the arrangement described, it is possible to provide a thermostat that has a pair of stops that can be conveniently set, at the factory or in the field, and which can be reset at the owner's desire. The adjustment allowed between the stops provides flexibility for heating and air conditioning in an environment, such as a hotel or motel room, within set limits.

In accordance with the present invention there is provided a thermostat for control of an environmental temperature, including: base means for support of temperature control means; lever means mounted on said base means with said lever means connected to said temperature control means to set said thermostat to operate at a selected temperature; said lever means movable between range setpoint stop means; slot means formed into said base means to mount said stop means; said slot means having a geometric design including a plurality of offset recessed openings on opposite sides of said slot means; said stop means having a plurality of projections which frictionally engage with and are held by said offset recessed openings; and said projections being shaped to allow said stop means to be removed, rotated, and reinserted to provide a plurality of temperature range setpoint stop positions when said stop means are mounted in said slot means.

DESCRIPTION OF PREFERRED EMBODIMENTS

Figure 1:
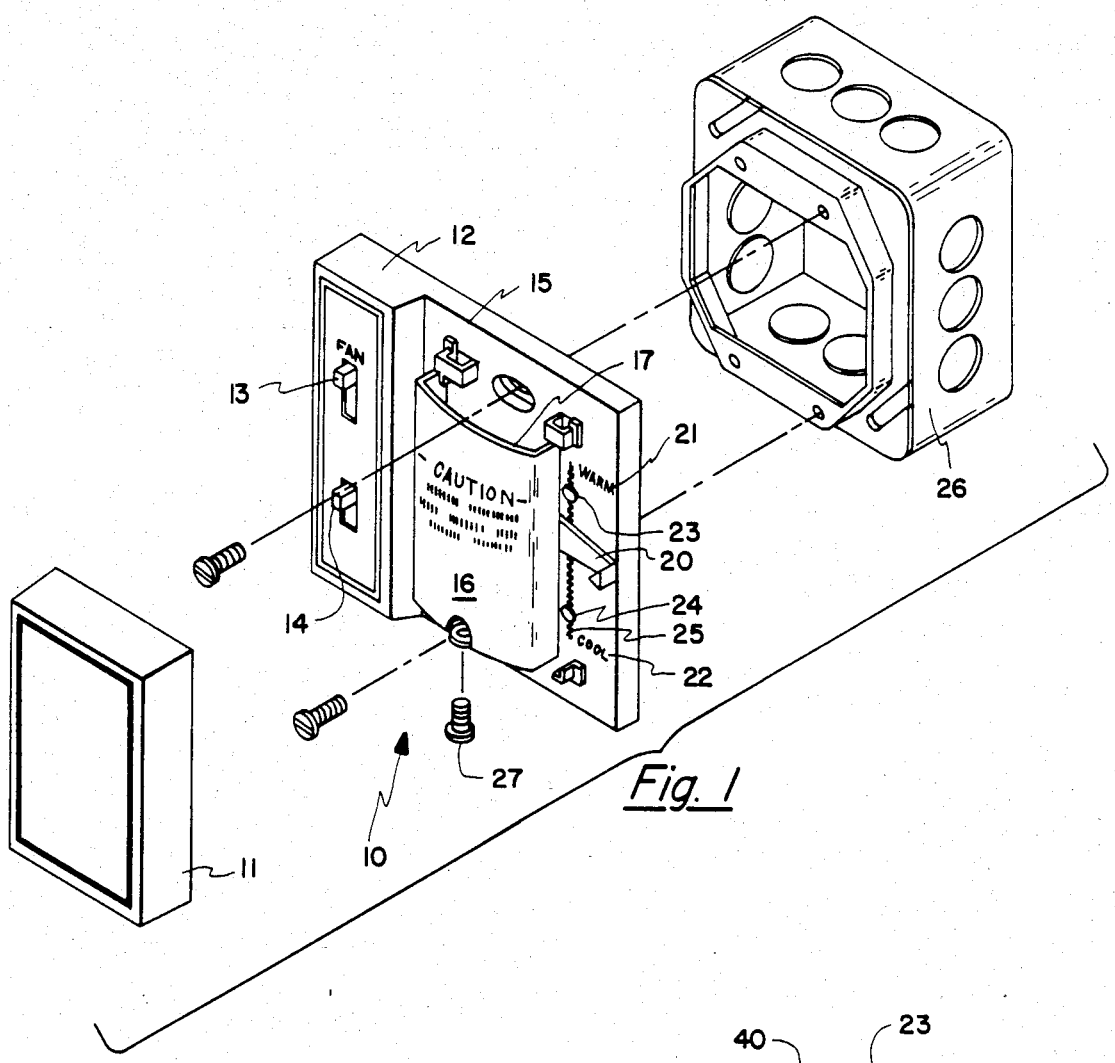
FIG. 1 is an exploded isometric drawing of a thermostat mounted on a conventional junction box.

In FIG. 1 there is disclosed an exploded isometric drawing of a T4039 fan coil thermostat as manufactured by Honeywell Inc. The thermostat incorporates the present invention, and has been disclosed in this form to clearly show how the present invention can be utilized.

A thermostat means 10 is generally disclosed as having a cover 11 and a molded plastic base 12. Mounted in and to the molded base 12 are a fan speed control switch 12 and an off-on switch 14. The base 12 has a mounting surface 15 upon which there is placed the necessary temperature control means 16. The temperature control means 16 is covered by a protective insulator 17 and is of a general type used in the previously mentioned T4039 thermostat.

Extending from the temperature control means 16 is a lever means 20 that is connected to the temperature control means 16 and is used to adjust the thermostat 10 to control at a desired point between a warm setting 21 and a cool setting 22. A pair of stops 23 and 24 are disclosed to limit the motion of the lever means 20. The stop means 23 and 24 are inserted in a slot means 25 that will be disclosed in detail in FIG. 2. The stops 23 and 24 are further captured by the cover 11. The cover 11 is secured by a tamperproof screw 27.

It is apparent that the lever means 20 is limited in its motion towards the warm setting 21 by the stop 23, and is limited towards the cool setting 22 by the stop 24. The stops 23 and 24 are adjustable prior to the placing of the cover 11 over the temperature control means portion 16. Once the thermostat has been set up and adjusted, it can be mounted on a conventional 4×4 junction box disclosed at 26. The electrical wiring to the thermostat is brought into the junction box 26 in a conventional manner and is well understood.

Figure 2:
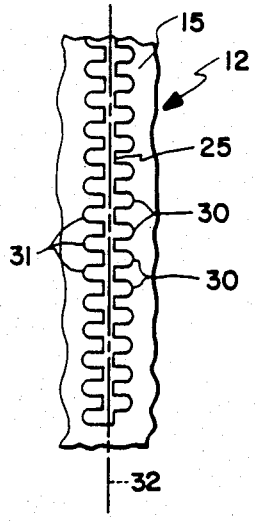
FIG. 2 is a detail of the geometrical design of a slot means.

In FIG. 2 the geometric pattern or design of the slot means 25 is disclosed. The slot means 25 is molded into the surface 15 of the base 12 of the thermostat 10. Only a portion of the geometric design is disclosed in FIG. 2 so that an understanding of the invention can be accomplished. The geometric design provides a plurality of offset recessed openings 30 and 31 on opposite sides of a plane 32 that passes down the center of the slot means 25. The recessed openings 30 and 31 are offset from one another by a distance that will allow a one degree temperature adjustment when the slot means is used in conjunction with the stop means 23 or 24. It will be understood that the slot means 25 can be molded into the base 12 to a convenient depth, or all the way through depending on the design and configuration of the base 12.

Figure 3:
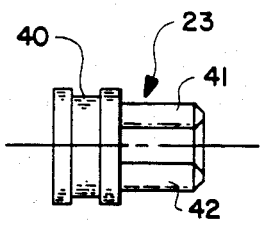
FIG. 3 is an elevation of a stop means.
Figure 4:
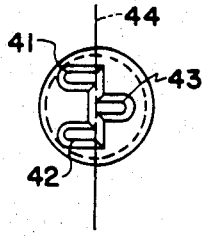
FIG. 4 is an end view of FIG. 3.

In FIGS. 3 and 4 the stop means are disclosed in detail. A stop means 23 is disclosed as having an upper circular portion 40 that is convenient for manually grasping the stop means 23, and for interacting with the lever means 20. The stop means 23 has a plurality of projections 41, 42, and 43. The projections 41 and 42 lie on one side of a plane 44 (as seen in FIG. 4), while the projection 43 lies on the opposite side of the plane 44. The projections 41 and 42 are equally spaced from the center of the projection 43. The projections 41, 42, and 43 are spaced to coincide with the geometric design of the plurality of recessed openings 30 and 31 in the slot means 25.

It will be understood that the stop means 23 (and its counterpart 24) can be removed by physically grasping the round portion 40 and pulling the stop means from the slot means 25. The stop means 23 and 24 can be rotated 180 degrees and reinserted, thereby causing the stop means to move a distance equal the distance between opposing projections 30 and 31 of the slot means 25. The projections 41, 42, and 43 are designed to frictionally engage the recessed openings 30 and 31, and this frictional engagement holds the stop means 23 and 24 in place.

Figure 5:
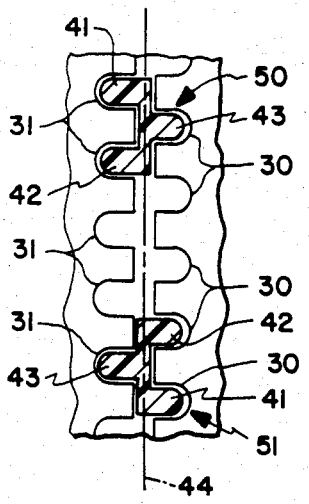
FIG. 5 is a representation of part of the slot means with two stop means showing alternate insertions.

In FIG. 5 two representations of two different positions of a stop means have been disclosed. The upper position 50 discloses the projections 41 and 42 on the left hand side of the center plane 44, while the stop means position disclosed at 51 have this arrangement reversed. As can be seen by reversing the position from 50 to 51, the stop means can be moved a small a distance as the distance between the projections 30 and 31, or the stop means can be moved over the entire length of the slot means 25. The provision for rotating the stop 180 degrees and the arrangement of slots is unique and provides for close settings of desired temperature.

With the arrangement thus disclosed it is possible to conveniently locate the upper and lower stop means 23 and 24 in a thermostat, and to make this adjustment in very small increments. It would be possible to further refine the stop means 23 by providing a larger number of projections that were offset from the center of the stop means 23. In effect an eccentric arrangement could be developed so that the stop means 23 could be moved by lesser or greater amounts by rotating it a lesser or greater amount than the 180 degrees shown. This would require that the slot means 25 be designed to agree with the spacing of the projections on the stop means. Details of this particular configuration have not been shown, but would be obvious to implement within the concept of the present invention. Since the present invention is susceptible of numerous implementations, the scope of the present invention is defined solely by the scope of the appended claims.

The embodiments of the invention in which an exclusive property or right is claimed are defined as follows:

1. A thermostat for control of an environmental temperature, including: base means for support of temperature control means; lever means mounted on said base means with said lever means connected to said temperature control means to set said control means to operate at a selected temperature; said lever means movable between range setpoint stop means; slot means formed into said base means to mount said stop means; said slot means having a geometric design including a plurality of offset recessed openings on opposite sides of said slot means; said stop means having a plurality of projections which frictionally engage with and are held by said offset recessed openings; and said projections being shaped to allow said stop means to be removed, rotated, and reinserted to provide a plurality of temperature range setpoint stop positions when said stop means are mounted in said slot means.

2. A thermostat as described in claim 1 wherein said projections extend from said stop means on opposite sides of a plane passing through a center of said stop means; and said plane generally coinciding with a centerline of said slot means.

3. A thermostat as claimed in claim 2 wherein said stop means has three projections with two of said projections extending on one side of said plane; and one projection extending from an opposite side of said plane.

4. A thermostat as claimed in claim 3 wherein said slot means and said projections are arranged so that said stop means can be removed, rotated 180 degrees, and reinserted to move said stop means a distance equal to a distance between adjacent recessed openings of said slot means.

5. A thermostat as claimed in claim 4 wherein said distance between adjacent recessed openings allows said stop means to be moved a distance to thereby allow said lever means to move one degree Fahrenheit.

* * * * *